US005275554A

United States Patent [19]

Faulkner

[11] Patent Number: 5,275,554

[45] Date of Patent: Jan. 4, 1994

[54] COMBUSTION SYSTEM WITH LOW $NO_x$ ADAPTER ASSEMBLY

[75] Inventor: Edward A. Faulkner, Shelton, Conn.

[73] Assignee: Power-Flame, Inc., Parsons, Kans.

[21] Appl. No.: 912,586

[22] Filed: Jul. 13, 1992

Related U.S. Application Data

[63] Continuation of Ser. No. 575,626, Aug. 31, 1990, abandoned.

[51] Int. Cl.[5] ..... F23L 7/00; F23L 9/00

[52] U.S. Cl. ..... 431/115; 431/9; 431/159; 431/154; 431/181; 431/187; 431/284

[56] References Cited

U.S. PATENT DOCUMENTS

| | | | |
|---|---|---|---|
| 964,031 | 7/1910 | Leahy . | |
| 2,110,209 | 3/1938 | Engels | 431/115 |
| 2,174,663 | 10/1939 | Keller | 431/115 |
| 2,430,101 | 11/1947 | Cambell, Jr. et al. | 431/115 |
| 2,532,214 | 11/1950 | Willenborg | 431/115 |
| 3,146,821 | 9/1964 | Wuetig | 431/115 |
| 3,369,587 | 2/1968 | Taubmann | 431/115 |
| 3,741,166 | 6/1973 | Bailey | 431/9 |
| 3,797,989 | 3/1974 | Gordon | 431/90 |
| 3,827,851 | 8/1974 | Walker | 431/175 |
| 3,832,122 | 8/1974 | La Haye et al. | 431/10 |
| 3,859,935 | 1/1975 | Walker | 431/175 |
| 4,245,980 | 1/1981 | Reed et al. | 431/182 |
| 4,347,052 | 8/1982 | Reed et al. | 431/188 |
| 4,380,429 | 4/1983 | La Haye et al. | 431/115 |
| 4,445,843 | 5/1984 | Nutcher | 431/115 |
| 4,483,832 | 11/1984 | Schirmer | 423/210 |
| 4,505,666 | 3/1985 | Martin et al. | 431/175 |
| 4,519,773 | 5/1985 | Parish et al. | 431/176 |
| 4,575,332 | 3/1986 | Oppenberg et al. | 431/9 |
| 4,618,323 | 10/1986 | Mansour | 431/177 |
| 4,629,413 | 12/1986 | Michelson et al. | 431/9 |
| 4,659,305 | 4/1987 | Nelson et al. | 431/9 |
| 4,815,966 | 3/1989 | Janssen | 431/115 X |
| 4,979,894 | 12/1990 | Oppenberg | 431/188 X |
| 4,995,807 | 2/1991 | Rampley et al. | 431/115 X |

FOREIGN PATENT DOCUMENTS

| | | | |
|---|---|---|---|
| 0071735 | 6/1977 | Japan | 431/115 |

*Primary Examiner*—Carl D. Price

*Attorney, Agent, or Firm*—Roylance, Abrams, Berdo & Goodman

[57] ABSTRACT

A low $NO_x$ combustion system for reducing the production of nitrogen oxides in its emissions by using a low $NO_x$ adapter assembly in conjunction with a heat exchanger and a standard burner. The low $NO_x$ adapter assembly includes a low $NO_x$ manifold housing coupled between the heat exchanger and the burner, a flue gas recirculating fan coupled to the stack of the heat exchanger and the low $NO_x$ manifold housing and an operating control mechanism for controlling and regulating the primary air, the recirculated flue gas and the fuel to the burner and the low $NO_x$ manifold housing. $NO_x$ is reduced by supplying recirculated flue gas and a secondary fuel into the combustion chamber of the heat exchanger adjacent the outlet end of the burner via the low $NO_x$ manifold housing.

16 Claims, 4 Drawing Sheets

COMBUSTION SYSTEM WITH LOW $NO_x$ ADAPTER ASSEMBLY

This is a continuation of application Ser. No. 07/575,626 filed Aug. 31, 1990 now abandoned.

FIELD OF THE INVENTION

This invention relates to a combustion system, such as a fire tube boiler or furnace, for burning oil or gas. More specifically, the invention relates to a combustion system that reduces the $NO_x$ emissions by supplying a secondary fuel and recirculated flue gas into a combustion chamber of a heat exchanger adjacent the outlet of the fuel burner. A separate low $NO_x$ adapter assembly delivers the recirculated flue gas and the secondary fuel directly into the combustion chamber.

BACKGROUND OF THE INVENTION

In the operation of heat exchangers, such as furnaces or boilers, various gases are produced such as nitrogen oxides ($NO_x$). Depending on the type of fuel being burned, two types of nitrogen oxides can be formed. Fuel bound $NO_x$ is formed as a result of nitrogen being present in the fuel itself, i.e., in fuel oils. During combustion, the nitrogen is released and quickly reacts with the oxygen in the combustion air to form $NO_x$. The reactions to the fuel bound $NO_x$ are not particularly temperature-dependent. Thermal $NO_x$ is formed, on the other hand, when high combustion temperatures break down the nitrogen gas in the combustion supporting air to atomic nitrogen. When this occurs, the atomic nitrogen will very quickly react with oxygen to form thermal $NO_x$.

If natural gas is employed as the furnace or boiler fuel, only thermal $NO_x$ is formed, because clean natural gas does not contain any nitrogen containing compounds. On the other hand, both thermal and fuel bound $NO_x$ are formed when burning fuel oils.

The production of $NO_x$ by the burning of fuels in the operation of boilers and furnaces is potentially damaging to the environment. Accordingly, various environmental emissions standards are being imposed by various governmental authorities and agencies to regulate and to suppress the formation of nitrogen oxides during operation of boilers and furnaces. Various techniques have been utilized in the design and operation of boilers and furnaces to meet those regulations.

For example, it is known that burning a hydrocarbon fuel in less than a stoichiometric concentration of oxygen will produce a reduced amount of CO and $H_2$. This concept is utilized in a staged airtype low $NO_x$ burner where the fuel is first burned in a deficiency of air in one zone to produce an environment that suppresses $NO_x$ formation, and then the remaining portion of the air is added in a subsequent zone.

Staged fuel also has been suggested for suppressing the $NO_x$ formation. In staged fuel, the air and some of the fuel is burned in the first zone and then the remaining fuel is added in the second zone. The presence of an overabundance of air in the first reaction zone acts as a dilutent, thus lowering the temperature and suppressing $NO_x$ formation. It is also known to recirculate flue gas to lower flame temperature and reduce $NO_x$ formation.

However, each of these prior art processes has certain inherent deficiencies and associated problems which have lead to limited commercial acceptance. For example, when burning fuel in a sub-stoichiometric oxygen environment the tendency for soot formation is increased. The presence of even a small amount of soot will alter the heat transfer properties of the heat exchanger surfaces downstream from the burner. Also, flame stability can be a critical factor when operating a burner at significantly sub-stoichiometric conditions. Moreover, many of the prior processes and systems have been complicated and expensive to build, install, use and maintain and require extensive modifications of standard furnaces, boiler and fuel burners.

Examples of prior heat exchangers and burners are disclosed in the following U.S. Pat. Nos.: 2,532,214 to Willenborg; 3,146,821 to Wuetig; 3,369,587 to Taubmann; 3,797,989 to Gordon; 3,827,851 to Walker; 3,859,935 to Walker; 4,245,980 to Reed et al.; 4,347,052 to Reed et al.; 4,380,429 to LaHaye et al.; 4,445,843 to Nutcher; 4,483,832 to Schirmer; 4,505,666 to Martin et al.; 4,575,332 to Oppenberg et al.; 4,618,323 to Mansour; and 4,629,413 to Michelson et al, the disclosures of which are hereby incorporated herein by reference.

This invention addresses these problems in the art, along with other needs and problems which will become apparent to those skilled in the art once given this disclosure.

SUMMARY OF THE INVENTION

Accordingly, a primary object of the invention is to provide a low $NO_x$ combustion system that reduces the amount of $NO_x$ formed during combustion by supplying recirculated flue gas and a secondary fuel into the combustion chamber downstream of the fuel burner.

Another object of the invention is to provide a low $NO_x$ adapter assembly for converting a standard combustion system into a low $NO_x$ combustion system.

Another object of the invention is to provide a low $NO_x$ combustion system which is relatively inexpensive to manufacture, install, use, and maintain, and requires no significant heat exchanger and fuel burner modification.

The foregoing objects are basically attained by providing a low $NO_x$ combustion system, the combination comprising: a heat exchanger having a combustion chamber and a flue gas stack; a burner having an outlet end; a primary fuel supply fluidly coupled to the burner for conveying a primary combustible fuel to the burner; an air supply fluidly coupled to the burner for conveying primary combustion supporting air to the burner; an ignition mechanism positioned adjacent the outlet end of the burner for igniting the primary combustible fuel; a flue gas recirculating system fluidly coupled to the flue gas stack for conveying flue gas into the combustion chamber adjacent the outlet end of the burner; and a secondary fuel supply coupled to the heat exchanger for conveying a secondary combustible fuel into the combustion chamber adjacent the outlet end of the burner.

The foregoing objects are also basically attained by providing a low $NO_x$ adapter assembly adapted to be coupled to a combustion system including a heat exchanger having a flue gas stack and a burner, the combination comprising: a housing having a first end and a second end with a bore extending between the first and second ends for receiving an outlet end of the burner through the first end; a mounting element coupled to the housing for coupling the housing to the heat exchanger; a flue gas recirculating system coupled to the housing for conveying flue gas from the flue gas stack of the heat exchanger to the bore of the housing; and a fuel supply coupled to the housing for fluidly conveying a combustible fuel adjacent the bore at the second end of the housing.

Other objects, advantages and salient features of the invention will become apparent from the following detailed description, which, taken in conjunction with the annexed drawings, discloses a preferred embodiment of the invention.

BRIEF DESCRIPTION OF THE DRAWING

Referring now to the drawings which form part of this original disclosure.

DETAILED DESCRIPTION OF THE INVENTION

Figure 1:
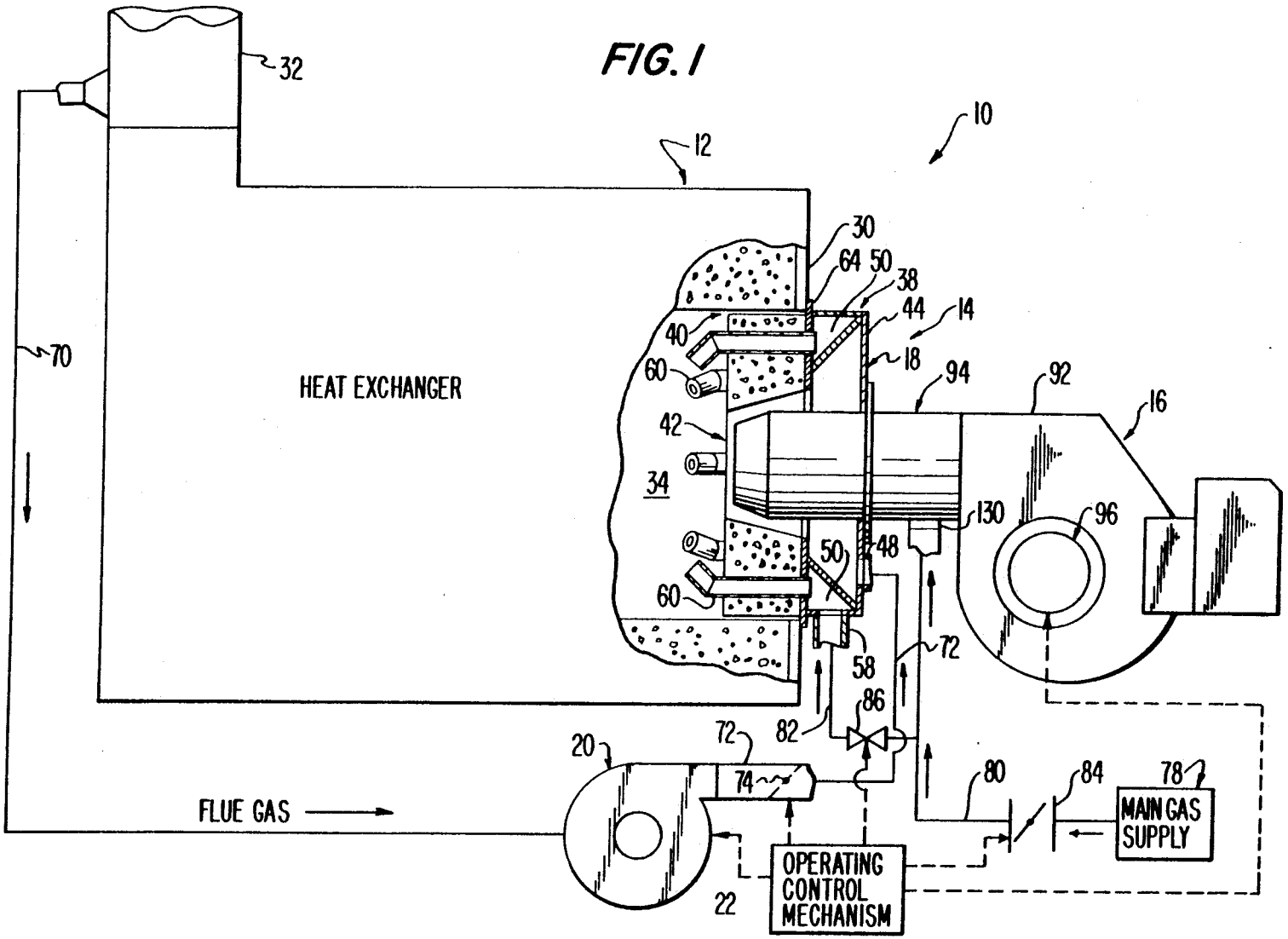
FIG. 1 is a pictorial schematic diagram of a low $NO_x$ combustion system in accordance with the present invention.

As seen in FIG. 1, a low $NO_x$ combustion system 10 in accordance with the present invention is illustrated and includes a heat exchanger 12 in the form of a furnace or boiler, a low $NO_x$ adapter assembly 14 rigidly coupled to heat exchanger 12, and a burner 16 rigidly coupled to adapter assembly 14. Low $NO_x$ adapter assembly 14 can be used with a standard fuel burner and heat exchanger and is merely installed between heat exchanger 12 and burner 16 to deliver recirculated flue gas and a secondary fuel directly into the heat exchanger. Thus, low $NO_x$ adapter assembly 14 includes a low $NO_x$ manifold housing 18 rigidly coupled between heat exchanger 12 and burner 16, a flue gas recirculating fan 20 fluidly coupled between the flue gas stack 32 of heat exchanger 12 and the low $NO_x$ manifold housing 18, and an operating control mechanism 22 for controlling and regulating the primary air supply, the primary and secondary gas supply and the amount of recirculated flue gas.

Heat exchanger 12 can be, for example, a conventional boiler, such as a Burnham Series 3P Scotch Marine Boiler, in which a liquid such as water is heated directly or indirectly. Heat exchanger 12 can also be, for example, a conventional furnace in which a gas such as air is heated directly or indirectly. Heat exchanger 12 has an outer housing 30 with its flue gas stack 32 rigidly coupled thereto and a combustion chamber 34 contained and formed therein.

Figure 3:
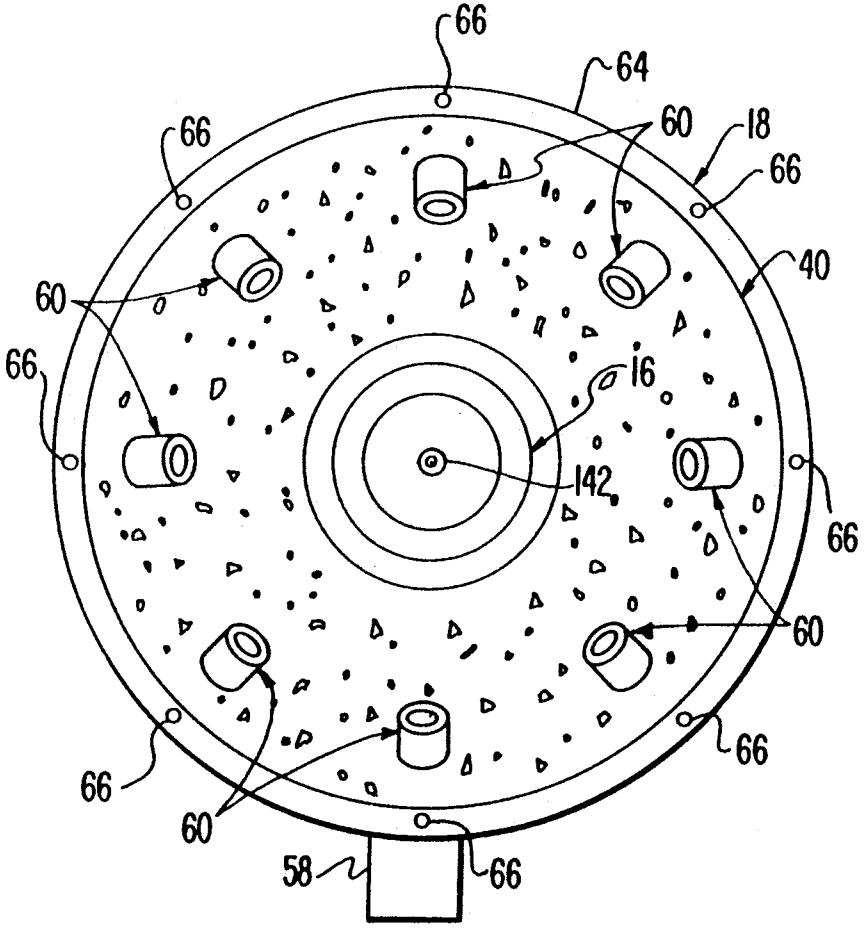
FIG. 3 is a left end elevational view of the low $NO_x$ manifold housing shown in FIG. 2.
Figure 2:
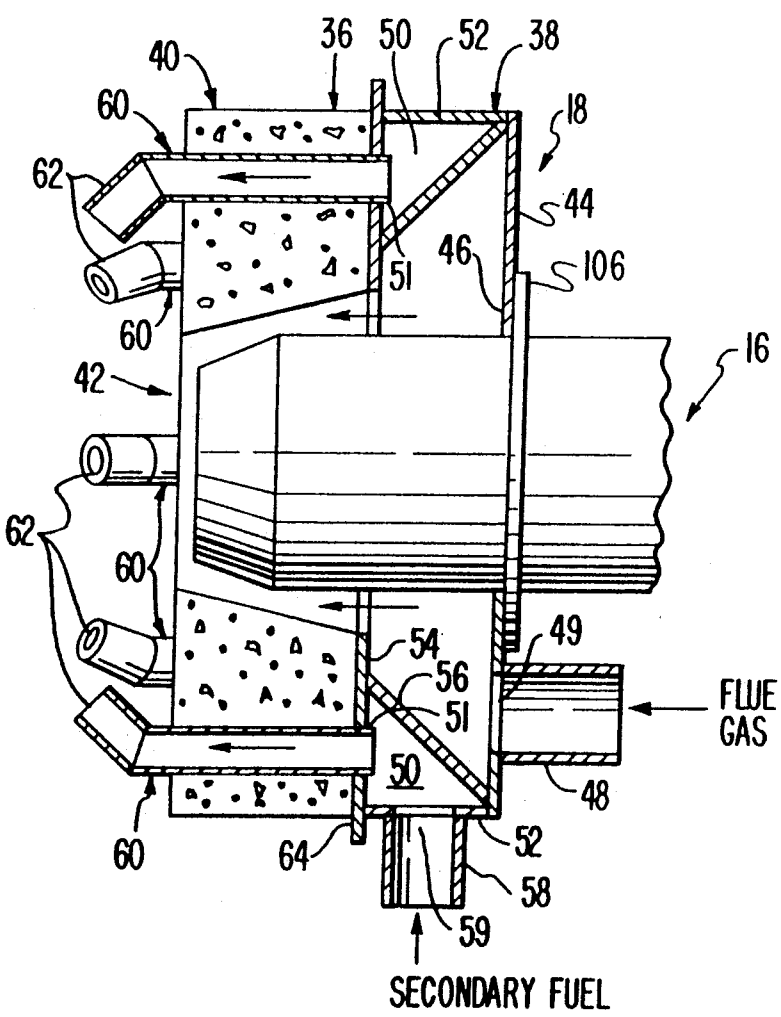
FIG. 2 is an enlarged side elevational view in longitudinal cross section of a low $NO_x$ manifold housing with an outlet end of a standard burner coupled thereto in accordance with the present invention.

Referring now to FIGS. 2 and 3, low $NO_x$ manifold housing 18 has an outer cylindrical wall 36 with a first end 38 constructed of a metallic material, such as carbon or stainless steel, and a second end 40 constructed of a refractory material. The refractory material of second end 40 is preferably about 4 inches thick. A through bore or passageway 42 extends axially between first and second ends 38 and 40 of manifold housing 18 and receives a portion of burner 16 through first end 38.

First end 38 of manifold housing 18 has an annular end wall 44 with a central circular opening 46 for receiving a portion of burner 16 therein, and a flue gas inlet 48 rigidly coupled to and coaxial with aperture 49 in annular end wall 44. Flue gas inlet 48 is fluidly coupled via tube 72 (FIG. 1) to flue gas recirculating fan 20 for fluidly conveying and communicating flue gas into bore 42. The flue gas surrounds the portion of burner 16 positioned in bore 42 and flows out of bore 42 through the annular space between the bore 42 and the burner 16 into combustion chamber 34 where the flue gas mixes immediately with the flame from burner 16 for lowering the temperature of the flame.

As seen in FIG. 2, an annular gas or fuel chamber 50 is formed in first end 38 of manifold housing 18, and is defined by an outer cylindrical wall 52, an annular inner wall 54 rigidly coupled to outer cylindrical wall 52 and a frustoconical wall 56 rigidly coupled between cylindrical wall 52 and annular inner wall 54. Walls 52, 54 and 56 are preferably made of a metallic material, such as stainless steel.

A natural gas inlet 58 is rigidly coupled to cylindrical wall 52 for fluidly conveying and communicating natural gas into gas chamber 50 through opening 59 in cylindrical wall 52. A plurality of gas orifices 51 are formed in annular inner wall 54 and arranged in a circular array for conveying and communicating the natural gas out of gas chamber 50 toward and into combustion chamber 34.

A plurality of gas outlet tubes 60 extend through the refractory material of the second end 40 of manifold housing 18 and are rigidly coupled to gas orifices 51 in annular inner wall 54 for fluidly communicating and conveying the gas from gas chamber 50 to combustion chamber 34 adjacent second end 40 of manifold housing 18. Gas outlet tubes 60, preferably, have their outlet ends 62 angled inwardly about 45 degrees towards the center of bore 42. Preferably, manifold housing 18 has a minimum of eight gas outlet tubes 60 arranged in a circular array around bore 42 for supplying the natural gas directly into the flame from burner 16 and into the combustion chamber 34.

A heat exchanger mounting flange 64 extends outwardly from annular inner wall 54 and has a plurality of mounting holes 66 for coupling manifold housing 18 to the outer housing 30 of heat exchanger 12 by suitable fasteners, not shown.

Referring again to FIG. 1, flue gas recirculating fan 20 is fluidly coupled to flue gas stack 32 by a tube 70 and is fluidly coupled to flue gas inlet 48 by tube 72 for conveying flue gas from stack 32 to combustion chamber 34 via bore 42.

Operating control mechanism 22 includes a butterfly valve 74 positioned in tube 72 for regulating the amount of flue gas entering combustion chamber 34. Butterfly valve 74 is connected to operating control mechanism 22 in a conventional manner, and thus will not be discussed in detail.

A main gas supply 78 is fluidly coupled to burner 16 via gas tube 80 for supplying the primary gas thereto and to low $NO_x$ manifold housing 18 via gas tube 82 for supplying the secondary gas to the combustion chamber 34 via chamber 50 and outlet tubes 60. In particular, gas tube 80 is rigidly coupled to main gas supply 78 and burner 16, while gas tube 82 is rigidly coupled to gas tube 80 and gas inlet 58. Operating control mechanism 22 includes a butterfly valve 84 located in gas tube 80 and a ball valve 86 in gas tube 82 for regulating the primary and secondary gas supply to burner 16 and combustion chamber 34, respectively. In other words, operating control mechanism 22 controls valves 84 and 86 for regulating the amount of gas entering burner 16 and combustion chamber 34. Alternatively, ball valve 84 can be manually adjusted and fixed in a desired position.

Operating control mechanisms, such as operating control mechanism 22, are conventional, and thus will not be discussed in detail herein. In all events, the control mechanism can be electrical or hydraulic, or even manual if desired, or can comprise simple mechanical linkages.

Figure 4:
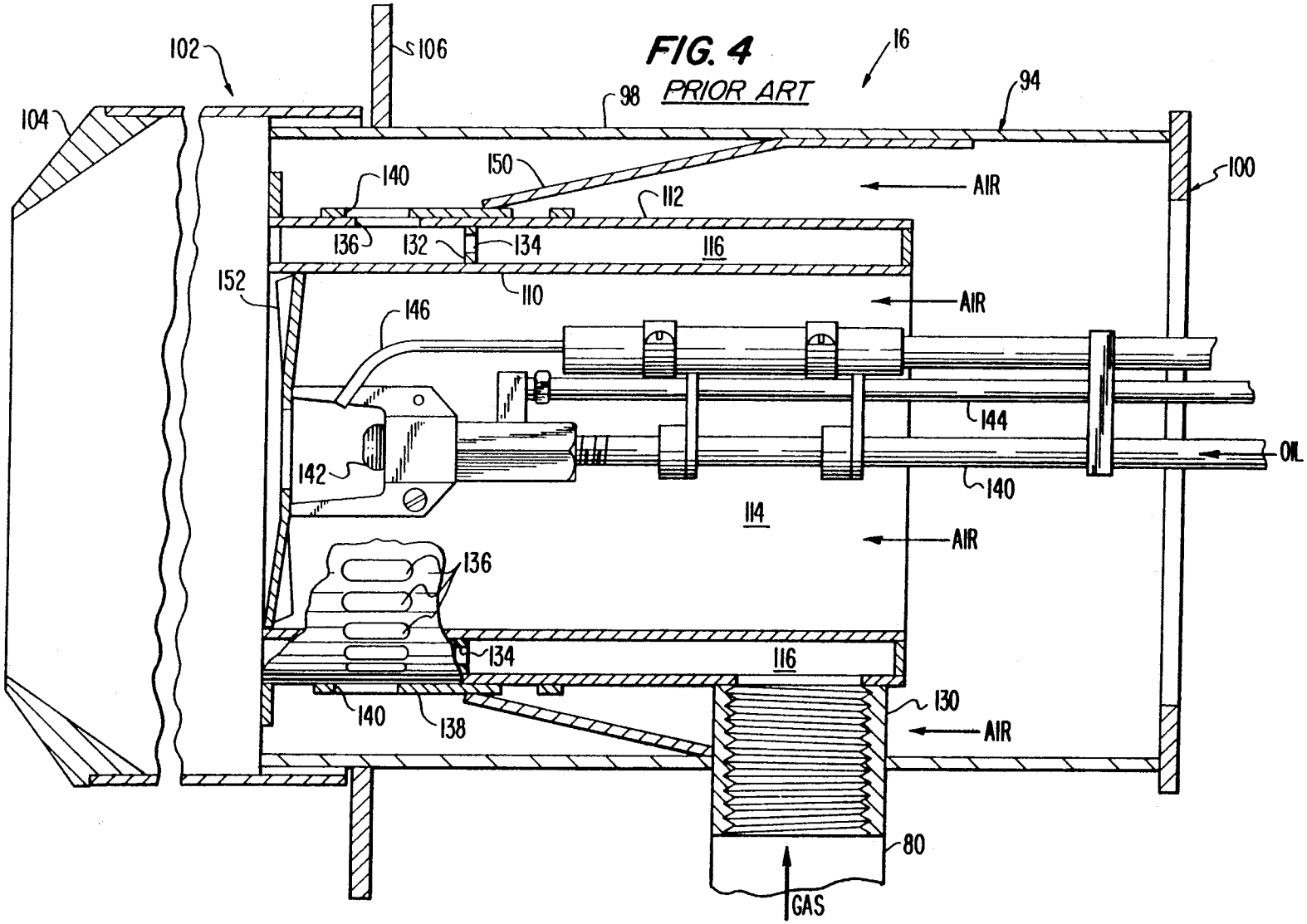
FIG. 4 PRIOR ART
FIG. 4 is an enlarged side elevational view in cross section of a firing tube of the standard burner used in the low $NO_x$ combustion system shown in FIGS. 1-3.
Figure 5:
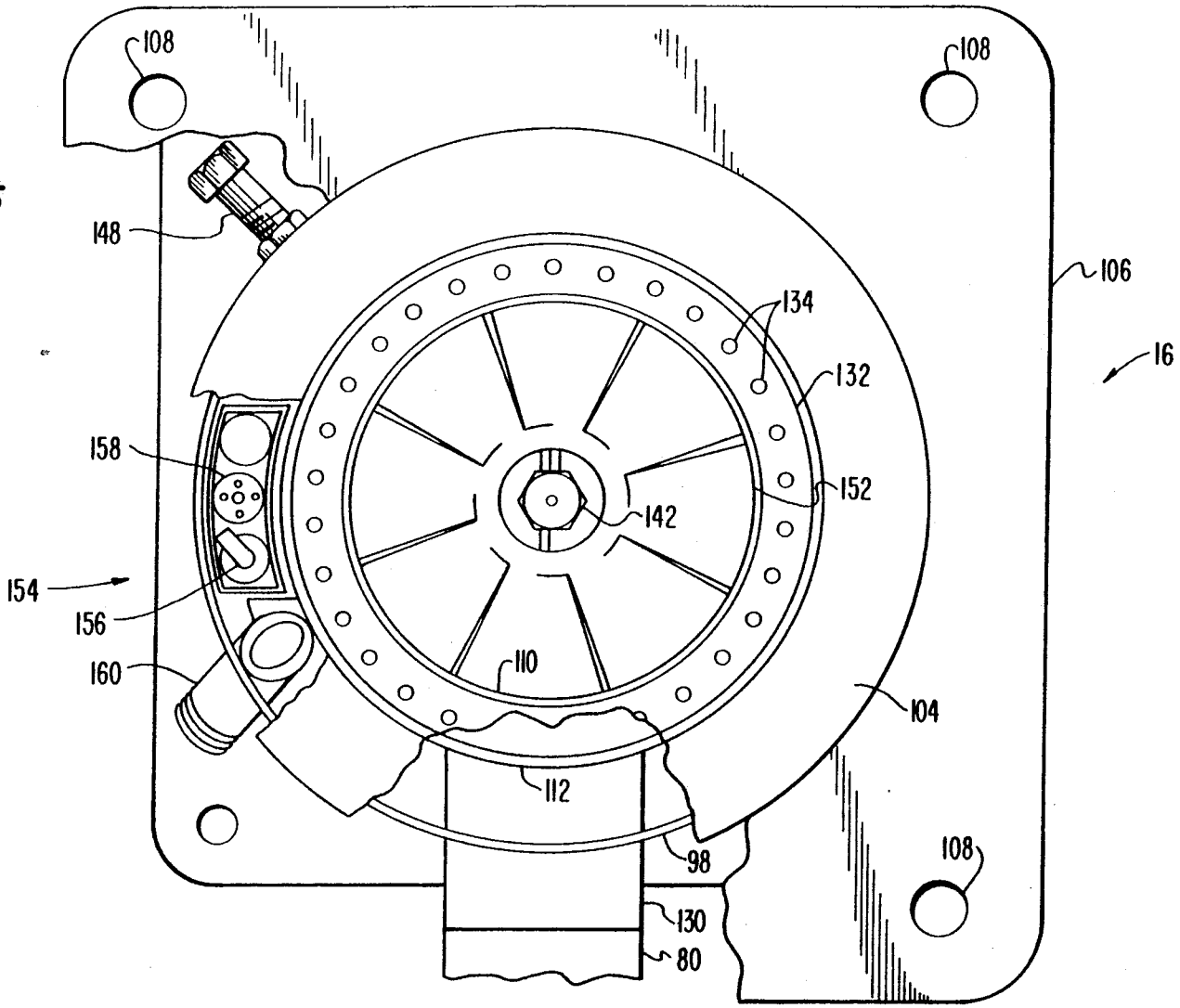
FIG. 5 is a partial left end elevational view of the fire tube of the standard burner shown in FIG. 4.

Referring now to FIGS. 1, 4 and 5, a standard burner 16 is illustrated, and includes a burner housing 92 with a fire tube 94 rigidly coupled thereto and a forced draft fan 96 rigidly coupled to burner housing 92 for supplying the primary combustion supporting air to fire tube 94. Burner 16 can be, for example, either a C3-G-20 or a C4-G-30 gas and oil burner manufactured by Power Flame Incorporated, and heat exchanger 12 can be, for example, a Burnham 3P 80HP boiler or a Burnham 3P 200HP boiler. Thus, the primary fuel may be natural gas or fuel oil. Since burner 16 is a conventional gas and oil burner, burner 16 will only be broadly discussed.

Fire tube 94 has an outer cylindrical housing 98 with an inlet end 100 and an outlet end 102 which is received in bore 42 of low $NO_x$ manifold housing 18. A choke assembly 104 is axially slidably coupled to the outlet end 102 of outer housing 98 in a conventional manner for longitudinally adjusting the length of fire tube 94. A rectangular flange 106 with four mounting holes 108 is rigidly coupled to outer housing 98 for releasably coupling burner 16 to end wall 44 of low $NO_x$ manifold housing 18 by fasteners, not shown.

As particularly seen in FIG. 4, the interior of fire tube 94 has a first tubular inner housing 110 and a second tubular inner housing 112 coaxially coupled within outer housing 98.

The interior of first tubular inner housing 110 defines a primary air passage 114 for conveying the primary air through fire tube 94. In particular, the primary air enters inlet end 100 from fan 96 to pass through fire tube 94, where it mixes with the primary fuel and is ignited, and then out outlet end 102 of fire tube 94 and into combustion chamber 34.

The space between first and second tubular inner housings 110 and 112 defines a gas chamber 116 for receiving the primary gas from main gas supply 78 via gas inlet tube 130 and gas tube 80. In particular, the primary gas is supplied to fire tube 94 of burner 16 from main gas supply 78 via gas tube 80 which is fluidly and rigidly coupled to gas inlet tube 130 of gas chamber 116.

A gas orifice ring 132 having a plurality of orifices 134 is rigidly coupled between first and second tubular inner housings 110 and 112 for dispensing the gas from gas chamber 116 towards outlet end 102 of burner 16.

Second tubular inner housing 112 has a plurality of oblong openings 136 adjacent the outlet side of gas orifice ring 132 for allowing the primary air passing between outer housing 98 and inner housing 112 to be premixed with the gas exiting gas chamber 116 through orifices 134. A damper ring 138 with a plurality of openings 140 is slidably coupled about the outer surface of second tubular inner housing 112 to cover part of or the entire length of openings 136 for controlling the amount of air to be premixed with the gas prior to combustion. An adjustment clamp 148 (FIG. 5) is fixedly coupled to damper ring 138 via bracket 150 for securing damper ring 138 in a desired position.

As seen in FIG. 5, the primary gas is ignited by a conventional gas pilot light assembly 154, which can also ignite the primary oil. Gas pilot light assembly 154 comprises a gas electrode 156, and a pilot gas supply nozzle 158 coupled to a suitable gas line. Assembly 154 is rigidly coupled to the forward ends of second inner housing 112 and outer housing 98 in the annular chamber formed therebetween. A conventional flame scanner connected to scanner pipe 160 uses ultraviolet or infrared light to determine the presence of the flame from the pilot gas supply nozzle, the primary oil supply and the primary gas supply, and is suitably connected to the operating control mechanism 22 to transmit signals to the control mechanism regarding the presence of the three relevant flames.

When burner 16 is to burn gas from main gas supply 78, a pilot flame created by electrode 156 and pilot gas supply nozzle 158 ignites the primary gas exiting from annular gas chamber 116. In addition, this pilot flame can also ignite primary oil.

The primary oil is supplied to burner 16 by an oil inlet tube 140 having oil nozzle 142 coupled thereto. An oil bypass tube 144 is provided for bleeding off oil to control the pressure of the oil exiting oil nozzle 142. A stainless steel spinner 152 is rotatably coupled to oil nozzle 142 for mixing the air and fuel together. Accordingly, oil is supplied to the fire tube 94 in a conventional manner and ignited by an ignition electrode 146, or by the gas pilot light assembly 154 located adjacent the spinner.

Operation

In operating low $NO_x$ combustion system 10, primary combustion supporting air is conveyed from fan 96 through fire tube 94 where it mixes with either oil supplied by oil nozzle 142, or gas supplied by main gas supply 78 via gas chamber 116. The oil or gas is then ignited in the outlet end 102 of fire tube 94 by ignition electrode 146 or gas pilot light assembly 154. Flue gas and secondary fuel, such as gas from tube 82, are then simultaneously injected from the manifold housing 18 via central bore 42 and gas outlet tubes 60 into combustion chamber 34 and into the flame from burner 16. In other words, the flue gas and secondary fuel are mixed in the combustion chamber 34 with the already combusted fuel and air mixture that has been ignited by burner 16.

Examples

A series of tests were conducted comparing various prior methods of controlling $NO_x$ emissions to the present invention. These tests were conducted on the Burnham 3P 80HP Scotch Marine Boiler with a Power Flame C3-G-20 modulating burner and the Burnham 3P 200HP Scotch Marine Boiler with a Power Flame C4-G-30 modulating burner. Stack emissions were monitored with three flue gas analyzers. Excess oxygen was monitored with an Ametek Thermox Model FCA analyzer. A THERMO ELECTRON Model 10AR Chemiluminescent analyzer with a Model 800 sample conditioner was used to monitor $NO_x$ emissions. Carbon monoxide was measured with an ENERAC Model 60 analyzer.

First, tests were conducted to determine $NO_x$ emissions of the standard heat exchanger systems. The results of these tests are shown in Table 1 indicating emissions in the 56 to 66.4 ppm range.

TABLE 1

| | Burnham 3P 80HP Boiler with Standard Burner | | | Burnham 3P 200HP Boiler with Standard Burner | | |
|---|---|---|---|---|---|---|
| GAS INPUT MBH | 1170 | 2200 | 3320 | 3020 | 5000 | 7600 |
| $O_2$ - % | 4.2 | 3.0 | 2.9 | 3.1 | 3.0 | 3.0 |
| $NO_x$ - PPM (Corrected to 3% $O_2$) | 66.4 | 63 | 60.7 | 59.3 | 59 | 56 |
| CO - PPM | 0 | 0 | 0 | 0 | 0 | 0 |
| STAGED FUEL | — | — | — | — | — | — |
| FGR DAMPER | — | — | — | — | — | — |
| STACK TEMP. °F. | 283 | 331 | 384 | 220 | 278 | 317 |
| FGR TEMP. °F. | — | — | — | — | — | — |

Second, tests were then conducted to determine $NO_x$ emissions of the heat exchanger systems with a secondary, or staged, fuel injected into the combustion chambers adjacent the outlets of the burners. The results of these tests are shown in Table 2 indicating emissions in the 35 to 44 ppm range.

TABLE 2

| | Burnham 3P 80HP Boiler and Burner with Fuel Staging | | | Burnham 3P 200HP Boiler and Burner with Fuel Staging | | |
|---|---|---|---|---|---|---|
| GAS INPUT MBH | 1140 | 2200 | 3410 | 2890 | 4800 | 8200 |
| $O_2$ - % | 3.0 | 3.0 | 3.0 | 3.0 | 3.0 | 3.0 |
| $NO_x$ - PPM (Corrected to 3% $O_2$) | 44 | 40 | 38 | 44 | 35 | 35 |
| CO - PPM | 0 | 0 | 0 | 0 | 0 | 0 |
| STAGED FUEL | Yes | Yes | Yes | Yes | Yes | Yes |
| FGR DAMPER | — | — | — | — | — | — |
| STACK TEMP. °F. | 269 | 332 | 391 | 246 | 281 | 323 |
| FGR TEMP. °F. | — | — | — | — | — | — |

Third, tests were then conducted to determine $NO_x$ emissions of the heat exchanger systems with flue gas recirculated around the outlet ends of the burners. Both rotating and parallel flows of the flue gas were tested. The results of these tests are shown in Tables 3A and 3B indicating emissions in the 43 to 52 ppm range.

TABLE 3A

| | Burnham 3P 80HP Boiler and Burner | | | | | |
|---|---|---|---|---|---|---|
| | Flue Gas Recirculation with Annular Rotation | | | Flue Gas Recirculation with Parallel Annular Flow | | |
| GAS INPUT MBH | 1230 | 2250 | 3360 | 1140 | 2200 | 3410 |
| $O_2$ - % | 3.0 | 3.0 | 3.0 | 3.1 | 3.0 | 3.0 |
| $NO_x$ - PPM (Corrected to 3% $O_2$) | 52 | 50 | 49 | 48 | 47 | 45 |
| CO - PPM | 0 | 0 | 0 | 0 | 0 | 0 |
| STAGED FUEL | — | — | — | — | — | — |
| FGR DAMPER | Open | Open | Open | Open | Open | Open |
| STACK TEMP. °F. | 287 | 344 | 390 | 295 | 340 | 395 |
| FGR TEMP. °F. | 270 | 330 | 380 | 275 | 330 | 382 |

TABLE 3B

| | Burnham 3P 200HP Boiler and Burner | | | | | |
|---|---|---|---|---|---|---|
| | Flue Gas Recirculation with Rotating Flow | | | Flue Gas Recirculation with Parallel Flow | | |
| GAS INPUT MBH | 3020 | 5030 | 7500 | 3010 | 4960 | 7380 |

TABLE 3B-continued

| | Burnham 3P 200HP Boiler and Burner | | | | | |
|---|---|---|---|---|---|---|
| | Flue Gas Recirculation with Rotating Flow | | | Flue Gas Recirculation with Parallel Flow | | |
| $O_2$ - % | 3.1 | 3.1 | 3.0 | 3.0 | 3.0 | 3.0 |
| $NO_x$ - PPM (Corrected to 3% $O_2$) | 49 | 48 | 47 | 47 | 44 | 43 |
| CO - PPM | 0 | 0 | 0 | 0 | 0 | 0 |
| STAGED FUEL | — | — | — | — | — | — |
| FGR DAMPER | Open | Open | Open | Open | Open | Open |
| STACK TEMP. °F. | 257 | 286 | 319 | 258 | 287 | 316 |
| FGR TEMP. °F. | 250 | 280 | 310 | 250 | 280 | 310 |

Fourth, tests were then conducted to determine $NO_x$ emissions of the heat exchanger systems with flue gas recirculated directly into the combustion supporting air in the burner. In particular, the recirculated flue gas was diverted from the flue gas recirculating fan into the inlet damper of the burner fan housing. The flue gas was then directly mixed with the combustion supporting air. While this method reduced $NO_x$ emissions significantly, it also produced many undesirable side effects. For example, the temperature of the housing was increased significantly which could adversely affect various burner components. Moreover, rust and corrosion inside the housing occurred rapidly when flue gas was mixed with the combustion supporting air. Furthermore, the flow of the flue gas had to be constantly monitored and controlled to maintain a stable flame. Accordingly, these side effects makes this method of reducing $NO_x$ emissions unfeasible. The results of these tests are shown in Table 4 indicating emissions in the 27 to 38 ppm range.

TABLE 4

| | Burnham 3P 80HP Boiler and Burner with Flue Gas Recirculation Directly Into Combustion Air | | Burnham 3P 200HP Boiler and Burner with Flue Gas Recirculation Directly Into Combustion Air | | |
|---|---|---|---|---|---|
| GAS INPUT MBH | 1170 | 3360 | 2770 | 4660 | 7620 |
| $O_2$ - % | 4.3 | 3.2 | 3.5 | 3.0 | 3.0 |
| $NO_x$ - PPM (Corrected to 3% $O_2$) | 27 | 27.3 | 38 | 31 | 27 |
| CO - PPM | 0 | 0 | 0 | 0 | 0 |
| STAGED FUEL | — | — | — | — | — |
| FGR DAMPER | Open | Open | Open | Open | Open |
| STACK TEMP. °F. | 289 | 394 | 252 | 276 | 309 |
| FGR TEMP. °F. | 275 | 390 | 235 | 260 | 300 |

Finally, tests were conducted on the present invention as illustrated in FIGS. 1-5 to determine $NO_x$ emissions of the heat exchanger systems with both recirculated flue gas and secondary fuel being injected into the combustion chamber. The results of these tests are shown in Table 5 indicating emissions in the 24 to 29 ppm range.

TABLE 5

| | Burnham 3P 80HP Boiler and Burner with Combination of Flue Gas Recirculation and Fuel Staging | | | Burnham 3P 200HP Boiler and Burner with Combination of Flue Gas Recirculation and Fuel Staging | | |
|---|---|---|---|---|---|---|
| GAS INPUT MBH | 1140 | 2200 | 3350 | 2830 | 4760 | 8200 |
| $O_2$ - % | 3.0 | 3.0 | 3.0 | 3.0 | 3.0 | 3.0 |
| $NO_x$ - PPM (Corrected to 3% $O_2$) | 29 | 27 | 25 | 29 | 27 | 24 |
| CO - PPM | 0 | 0 | 0 | 0 | 0 | 0 |
| STAGED FUEL | Yes | Yes | Yes | Yes | Yes | Yes |
| FGR DAMPER | Open | Open | Open | Open | Open | Open |
| STACK TEMP. °F. | 295 | 351 | 396 | 254 | 288 | 327 |
| FGR TEMP. TEMP. °F. | 285 | 340 | 380 | 240 | 270 | 325 |

As is evident from the above tests, $NO_x$ emissions were significantly reduced when both recirculated flue gas and secondary fuel are injected into the combustion chamber of a heat exchanger without adverse side effects as compared to the other tested methods.

While only one embodiment has been chosen to illustrate the invention, it will be understood by those skilled in the art that various changes and modifications can be made herein without departing from the scope of the invention as defined in the appended claims.

What is claimed is:

1. A low $NO_x$ adapter assembly adapted to be coupled to a combustion system including a heat exchanger having a flue gas stack and a burner having a source of primary fuel and a fire tube with an outlet end, comprising:

a separate housing having a first end and a second end with a bore extending through said housing between said first and second ends of said housing for receiving the fire tube of the burner through said first end, said second end of said housing being received in the heat exchanger;

said housing further including flue gas conveying means for conveying flue gas into and through said bore and into the heat exchanger adjacent the outlet end of the fire tube of the burner, and secondary fuel conveying means for conveying a secondary combustible fuel into the heat exchanger adjacent the outlet end of the fire tube of the burner;

first mounting means, coupled to said first end of said housing, for releasably coupling said first end of said housing to the burner to position the fire tube of the burner in said bore of said housing; and second mounting means, coupled to said second end of said housing, for releasably coupling said second end of said housing to the heat exchanger to position said second end of said housing in the heat exchanger.

2. A low $NO_x$ combustion system, the combination comprising:

a heat exchanger having a combustion chamber and a flue gas stack;

a burner having a fire tube with an outlet end;

primary fuel means, fluidly coupled to said burner, for conveying a primary combustible fuel to said burner;

air means, fluidly coupled to said burner, for conveying primary combustion supporting air to said burner;

igniting means, positioned adjacent said outlet end of said burner, for igniting said primary combustible fuel;

a separate low $NO_x$ adapter assembly coupled to said heat exchanger and coupled to said burner, said adapter assembly including first and second ends with a bore extending through said adapter assembly between said first and second ends of said adapter assembly for receiving said fire tube of said burner therein, said second end of said adapter assembly being received in said heat exchanger, flue gas conveying means for conveying flue gas into and through said bore and into said combustion chamber adjacent said outlet end of said fire tube of said burner, secondary fuel conveying means for conveying a secondary combustible fuel into said combustion chamber adjacent said outlet end of said fire tube of said burner, first mounting means for releasably coupling said first end of said separate low $NO_x$ adapter assembly to said fire tube of said burner, and second mounting means for releasably coupling said second end of said separate low $NO_x$ adapter assembly to said combustion chamber of said heat exchanger, flue gas recirculating means, fluidly coupled to said flue gas stack and to said flue gas conveying means in said adapter assembly, for supplying flue gas to said flue gas conveying means in said adapter assembly; and secondary fuel means, fluidly coupled to said secondary fuel conveying means in said adapter assembly, for supplying a secondary combustible fuel to said secondary fuel conveying means in said adapter assembly.

3. A low $NO_x$ combustion system according to claim 2, wherein said primary combustible fuel is natural gas.

4. A low $NO_x$ combustion system according to claim 3, wherein said secondary combustible fuel is natural gas.

5. A low $NO_x$ combustion system according to claim 2, wherein said primary combustible fuel is oil.

6. A low $NO_x$ combustion system according to claim 2, wherein said secondary combustible fuel is natural gas.

7. A low $NO_x$ combustion system according to claim 1, wherein said flue gas conveying means communicates with said bore of said housing for conveying the flue gas around said fire tube of said burner positioned in said bore.

8. A low $NO_x$ combustion system according to claim 7, wherein said secondary fuel conveying means includes an annular fuel chamber fluidly coupled to said secondary fuel means and a plurality of openings in said fuel chamber for supplying the secondary combustible fuel from said fuel chamber to said combustion chamber.

9. A low $NO_x$ combustion system according to claim 8, wherein each of said openings in said fuel chamber has an outlet pipe coupled thereto.

10. A low $NO_x$ combustion system according to claim 9, wherein each of said outlet pipes has an end angled inwardly towards said outlet end of said burner.

11. A low $NO_x$ adapter assembly adapted to be coupled to a combustion system including a heat exchanger having a flue gas stack and a burner having a source of primary fuel and a fire tube with an outlet end, comprising:

a separate housing having a first end and a second end with a bore extending through said housing between said first and second ends of said housing for receiving the fire tube of the burner through said first end, said second end of said housing being received in the heat exchanger;

said housing further including flue gas conveying means for conveying flue gas into and through said bore and into the heat exchanger adjacent the outlet end of the fire tube of the burner, and secondary fuel conveying means for conveying a secondary combustible fuel into the heat exchanger adjacent the outlet end of the fire tube of the burner;

first mounting means, coupled to said housing, for releasably coupling said housing to the burner to position the fire tube of the burner in said bore of said housing;

second mounting means, coupled to said housing, for releasably coupling said housing to the heat exchanger to position said second end of said housing in the heat exchanger;

flue gas recirculating means, adapted to be coupled to said flue gas stack and coupled to said flue gas conveying means in said housing, for supplying flue gas from the flue gas stack of the heat exchanger to said flue gas conveying means in said housing; and fuel means, coupled to said secondary fuel conveying means in said housing, for supplying a secondary combustible fuel to said secondary fuel conveying means in said housing.

12. A low $NO_x$ adapter according to claim 11, wherein said secondary fuel conveying means includes an annular fuel chamber with an inlet and an outlet.

13. A low $NO_x$ adapter according to claim 12, wherein said outlet includes a plurality of openings arranged in a circular array.

14. A low $NO_x$ adapter according to claim 13, wherein each of said openings has an outlet pipe coupled thereto.

15. A low $NO_x$ adapter according to claim 14, wherein each of said outlet pipes has an end angled inwardly towards the center of said bore.

16. A low $NO_x$ adapter according to claim 14, wherein said outlet includes at least eight of said outlet pipes.

* * * * *

UNITED STATES PATENT AND TRADEMARK OFFICE

CERTIFICATE OF CORRECTION

PATENT NO. : 5,275,554
DATED : January 4, 1994
INVENTOR(S) : Edward A. Faulkner, Jr.

It is certified that error appears in the above-indentified patent and that said Letters Patent is hereby corrected as shown below:

Claim 7, column 10, line 58, delete "1" and insert -- 2 --.

Signed and Sealed this

Fifth Day of July, 1994

*Attest:*

*Attesting Officer*

BRUCE LEHMAN

*Commissioner of Patents and Trademarks*